United States Patent [19]

Kusahara

[11] 4,145,792

[45] Mar. 27, 1979

[54] DEVICE FOR RETURNING EXCESS FIBERS FROM CYLINDER OF CARDING MACHINE

[76] Inventor: Kazutomi Kusahara, 1-11-13, Tachibana Nishinariku, Osaka, Japan

[21] Appl. No.: 847,809

[22] Filed: Nov. 2, 1977

[30] Foreign Application Priority Data

Jun. 29, 1977 [JP] Japan ..... 52/86809[U]

[51] Int. Cl.[2] ..... D01G 15/40

[52] U.S. Cl. ..... 19/105; 19/107

[58] Field of Search ..... 19/156.3, 156.4, 105, 19/107

[56] References Cited

U.S. PATENT DOCUMENTS 490,271 1/1893 Crooks ..... 19/156.4

FOREIGN PATENT DOCUMENTS 2028317 12/1970 Fed. Rep. of Germany ..... 19/105

14616 8/1966 Japan ..... 19/107

920478 3/1963 United Kingdom ..... 19/105

*Primary Examiner*—Dorsey Newton

[57] ABSTRACT

A device comprises a guide cover extending from above the taker-in roller on one side of the cylinder toward and over a feed roller and defining a passage for the air stream produced by the rotation of the taker-in roller to return fibers entrained in the air stream onto a lap on the dish plate. The guide cover is provided with auxiliary guide plates disposed within the passage and extending respectively from the opposite side walls of the guide cover toward the center of the passage while slanting toward the direction of advance of the air stream with respect to the axis of the taker-in roller when seen in plan, each of the guide plates being provided with a guide face having a progressively reducing width toward its forward end. A control roller is disposed between the guide cover and the cylinder and positioned close to the periphery of the cylinder and the periphery of the taker-in roller.

2 Claims, 6 Drawing Figures

DEVICE FOR RETURNING EXCESS FIBERS FROM CYLINDER OF CARDING MACHINE

BACKGROUND OF THE INVENTION

This invention relates to an air stream guiding device for a carding machine which comprises a cover disposed above the taker-in roller for guiding the air stream induced by the rotation of the taker-in roller and by which excess fibers as entrained in the air stream can be deposited on a lap on the dish plate.

Devices of this type heretofore known are merely in the form of an air stream guiding cover consisting of side plates provided at the opposite ends of and above the taker-in roller and extending from one side of the roller near the cylinder to a position above the feed roller and a cover portion extending between the upper edges of the side plates. The air stream produced by the rotation of the taker-in roller and guided by the cover tends to force out the air-borne fibers in larger quantities at the opposite sides of the air outlet between the cover and the feed roller when flowing out from the outlet against the dish plate. Consequently the lap B on the dish plate on which the discharged fibers are deposited will have an exceedingly greater thickness at its opposite sides than at the mid-portion thereof as seen in FIG. 1, with the result that an increasing amount of fibers will be wound on the ends of the feed roller A, forming a diametrically increasing accumulation of fibers on each end and rendering the feed roller no longer smoothly rotatable. Such a trouble takes place periodically during the operation of the carding machine and must therefore be eliminated similarly periodically. Moreover the operator must always be attentive to the accumulation of fibers. Further, there are cases where a control roller is installed above and close to the taker-in roller and cylinder so that it combs out excess fibers from the fibers delived to the periphery of the cylinder and returns them to the taker-in roller, which, in turn, feeds them back toward the feed roller. In such cases, the amount of fibers being returned to the lap B on the dish plate by the air stream incidental to the rotation of the taker-in roller will increase, with the result that irregularities in the thickness of said lap B, wrapping of fibers around the feed roller and jamming with fibers will be caused much earlier and to a greater extent. The operator would then have much difficulty taking care of the operation of the carding machine.

SUMMARY OF THE INVENTION

An object of this invention is to provide a device of simple construction for guiding the air stream induced by rotation of the cylinder comprising an improved air stream guide disposed above the taker-in roller by which excess fibers from the cylinder can be returned onto the lap with uniform distribution as entrained in the air stream induced by and following the rotation of the taker-in roller to render the lap uniform in thickness and eliminate the problems to be otherwise encountered.

The device of this invention is characterized in that an air stream guiding cover disposed above the taker-in roller and defining a passage for passing the air stream produced by the taker-in roller is provided with auxiliary guide plates for directing the air stream toward the center of the passage.

The auxiliary guide plates extend respectively from the side walls of the cover toward the center of the air stream passage while slanting toward the direction of advance of the air stream with respect to the axis of the taker-in roller when seen in plan, each of the guide plates being provided with a guide face having a progressively reducing width toward its forward end.

With the use of the device of this invention, the air flowing through the cover is compressed toward the opposite sides of the passage, with the result that the portion of the air stream closer to the opposite sides have a greater force. At positions closer to the opposite sides of the passage, the air stream is guided by the auxiliary guide plates more greatly and is thereby markedly deflected toward the center of the passage, so that the force distribution and density distribution of the air stream flowing through the passage are made uniform, permitting the fibers entrained in the stream to return to the lap as uniformly dispersed thereon. Consequently the lap will have a uniform thickness over the entire width thereof and will not be wound on the feed roller.

By virtue of this construction, the layer of the fibers to be transferred by the cylinder has a uniform thickness and is fully subjected to the carding operation, thereby being made into a silver of uniform thickness. The present device serves to reduce the damage to the teeth on the cylinder, giving a prolonged life to the carding cloth ensuring improved quality of the product and a control roller is installed between the taker-in roller and cylinder. Although a greatly increased quantity of fibers will be returned to the taker-in roller, the returned excess fibers will not produce any objection since the auxiliary guide plates act to disperse the fibers uniformly over the lap.

Other features of this invention will become apparent from the following description and the accompanying drawings.

DESCRIPTION OF THE PREFERRED EMBODIMENT

Figure 1:
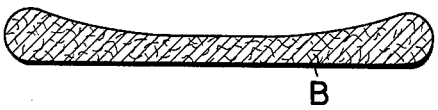
FIG. 1 is a sectional view showing a lap having an uneven thickness in the direction of its width.
Figure 2:
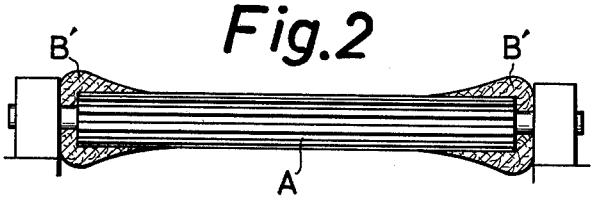
FIG. 2 is a front view showing a feed roller having wound thereon fibers owing to the unevenness of the thickness of a lap, the fiber portions being shown in section.
Figure 3:
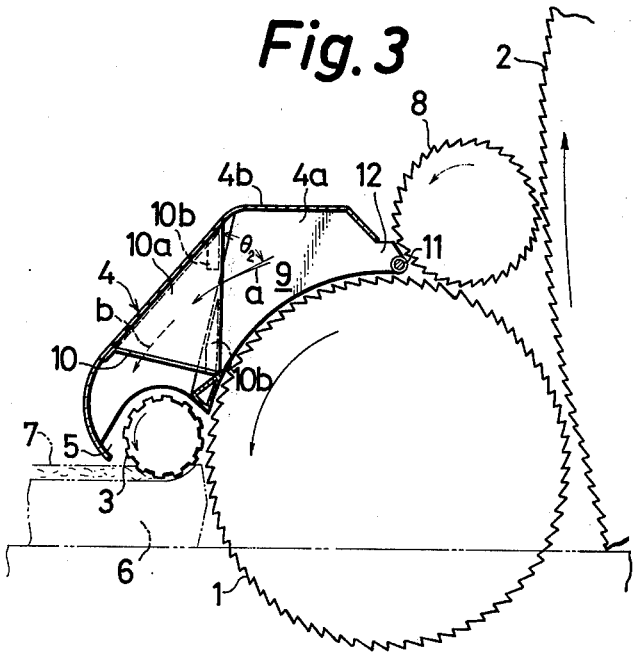
FIG. 3 is a sectional view showing a preferred embodiment of this invention.
Figure 4:
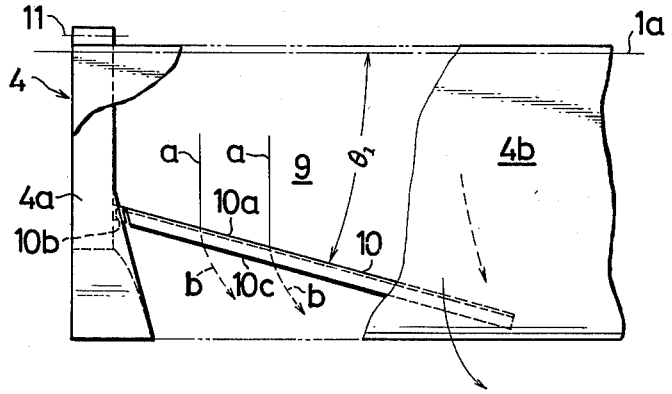
FIG. 4 is a plan view showing part of the embodiment of FIG. 3.
Figure 5:
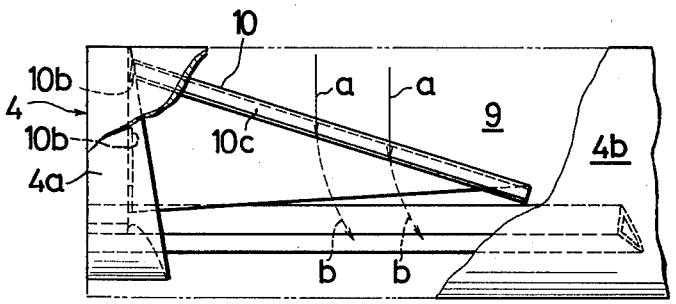
FIG. 5 is a front view showing part of the same.

With reference to FIGS. 3 to 5 showing the most preferred embodiment of this invention, indicated at 1 is a taker-in roller, at 2 a cylinder at 6, a dish plate and at 3 a feed roller. Provided over the taker-in roller 1 is a guide cover 4 extending from one side of the cylinder 2 toward and over the feed roller 3. The cover 4 comprises opposite side plates 4*a* and a cover portion 4*b* extending between and joined to the upper edges of the side plates 4*a* as in the prior art. The guide cover 4 defines an air stream passage 9 with an inlet between the cover and the taker-in roller and an outlet 5 directing air onto the dish plate. Disposed at an intermediate portion of the passage 9 on the opposite sides thereof are auxiliary guide plates 10 each extending from the side plate 4*a* toward the center of the passage 9 while slanting toward the direction of the advance of the air stream (indicated by arrows a in FIG. 4) at an angle $\theta_1$ with respect to the axis 1*a* of the taker-in roller when seen in plan. Each guide plate 10 is in the form of a triangular plate with its guide face 10*a* having a progressively reducing width toward its forward end. The auxiliary guide plate 10 is attached at its base portion 10*b* to the side plate 4*a* and at its upper edge 10*c* to the rear face of the guide cover portion 4*b*. When seen sidewise, the guide face 10*a* is inclined at an angle $\theta_2$ with respect to the direction of advance of the air stream as shown in FIG. 3. The guide cover 4 is openable and closable with its side plates 4*a* pivotably supported at their rear ends as indicated at 11.

A control roller 8 provided between the guide cover 4 and the cylinder 2 is positioned close to the periphery of the taker-in roller 1 and the periphery of the cylinder 2. The roller 8 is provided over its peripheral surface with a carding cloth or serrated matallic wire, thus serving as a toothed roller. The roller 8 is driven in the same direction as the taker-in roller 1 at a lower peripheral speed than the roller 1 and the cylinder 2. The tips of the teeth are inclined in the direction of rotation of the roller 8.

Figure 6:
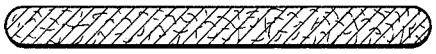
FIG. 6 is a sectional view showing a lap in the case of this invention.

The air stream produced by and following the rotation of the taker-in roller 1 flows into the guide cover 4 through an inlet 12 between the cover and the taker-in roller 1 and advances through the passage 9 in the direction of the arrows a by being guided by the guide cover 4. However, the air stream is deflected toward the center of the passage 9 as indicated by the arrows b on striking the guide faces 10*a* of the auxiliary guide plate 10. Since the guide face 10*a* of the auxiliary guide plate 10 has a progressively reducing area toward its forward end, the portion of the air stream flowing closer to the cover side plate 4*a* defining the passage 9 will be subjected more greatly to the deflecting action, with the resulting tendency that the air stream portion will flow out from an outlet 5 with higher pressure at the center thereof than at the side. Consequently the fibers can be forced out from the outlet 5 at a uniform rate and with uniform pressure over the entire transverse width of the outlet 5. The lap 7 onto which these fibers are returned therefore has a uniform thickness over the entire width thereof as seen in FIG. 6.

In brief, the auxiliary guide plates 10 function to suitably concentrate the air stream through the passage 9 to the center portion of the passage 9 to remedy the unevenness of the amount of fibers to be discharged. The degree of projection of the auxiliary guide plates 10 toward the center, the width and other dimensional changes of the places and the inclination thereof with respect to the direction of the advance of the air stream are suitably determined. The area of the guide faces 10*a* may be progressively decreased by varying the width of the guide plates 10 or, alternatively, by forming in the plates apertures in varying sized or at varying spacing distances.

On the other hand, the excess fibers delivered to the cylinder 2 are slowly but positively combed out by the control roller 8 owing to its peripheral speed which is much lower than that of the cylinder 2 and to the direction of the teeth, with the result that the fibers conveyed by the cylinder 2 are in the form of a layer of uniform thickness and will not damage the teeth. This ensures a uniform carding operation, giving a sliver free of irregularities in its thickness. Moreover excess fibers are slowly combed out by the control roller 8 from the cylinder and transferred as dispersed on the peripheral surface of the roller 8. Since the excess fibers are conveyed on the control roller 8, then transferred from the roller 8 to the roller 1, thereafter carried on the roller 1 or by the air stream and finally returned to the lap, the fibers can be further dispersed during travel along such a long path, rendering the lap uniform in thickness in longitudinal direction and feedable at a uniform rate. Although an increased amount of fibers will be returned to the lap, the air stream guiding action of the auxiliary guide plates 10 ensures evenness of the thickness of the lap in the direction of its width.

What is claimed is:

1. In a carding machine including a dish plate, a feed roller over the dish plate, a taker-in roller adjacent the feed roller, a card cylinder adjacent the taker-in roller and a guide cover for guiding an air stream created by rotation of the taker-in roller toward the dish plate, said guide cover extending from above the taker-in roller on one side of the cylinder toward and above the feed roller, said guide cover having opposite side walls and defining an air stream passage having an inlet between said cover and the periphery of the taker-in roller on said one side of the cylinder and an outlet between said cover and a part of the feed roller remote from the taker-in roller, said air stream outlet being directed onto the dish plate, the improvement wherein said guide cover includes auxiliary guide plates extending from inner surfaces of said opposite side walls respectively for directing an air stream flowing through said passage toward the center of said passage, said auxiliary guide plates extending from the cover side walls respectively toward the center of said passage and slanting from the respective side walls forwardly in the direction of advance of the air stream towards said outlet, each of said plates having a guide face which reduces progressively in width toward its forward end.

2. The improvement as claimed in claim 1 including a control roller between the guide cover and the cylinder for combing excess fibers from the cylinder and returning such fibers to the taker-in roller.

* * * * *